United States Patent [19]

Rand

[11] 4,217,671

[45] Aug. 19, 1980

[54] MULTIPURPOSE CLEANING DEVICE

[76] Inventor: Bobby J. Rand, 3401 Dogwood Dr., Raleigh, N.C. 27604

[21] Appl. No.: 6,469

[22] Filed: Jan. 25, 1979

[51] Int. Cl.[2] ..... A46B 13/04

[52] U.S. Cl. ..... 15/24; 15/29

[58] Field of Search ..... 15/23, 24, 28, 29, 97 R, 15/22 R

[56] References Cited

U.S. PATENT DOCUMENTS

| | | | |
|---|---|---|---|
| 1,243,825 | 10/1917 | Escutchen | 15/28 |
| 1,460,765 | 7/1923 | Norris | 15/28 |
| 1,641,103 | 8/1927 | Small | 15/28 X |
| 2,287,725 | 6/1942 | Conte | 15/23 |
| 2,443,001 | 6/1948 | Frendo | 15/28 |
| 2,668,968 | 2/1954 | Dobrowolski | 15/28 |
| 3,060,472 | 10/1962 | Horton | 15/29 X |
| 3,293,678 | 12/1966 | South | 15/29 |
| 3,380,093 | 4/1968 | Hill | 15/23 |
| 4,089,079 | 5/1968 | Nicholson | 15/29 |

*Primary Examiner*—Edward L. Roberts
*Attorney, Agent, or Firm*—Mills & Coats

[57] ABSTRACT

In abstract a preferred embodiment of this invention is a multipurpose cleaning device which can be used as a bath and tile scrubbing device, can be used for cleaning the interior of toilet bowls and other hard to reach locations as well as being adapted for use in conjunction with floors, walls, ceilings and the like. The device is in the form of an encapsulated motor or engine which is preferably at least water resistant in construction and has a removable longitudinally extending handle as well as laterally disposed gripping means. Dispensing means are also included in the present invention as are a plurality of different shaped scrubbing means.

7 Claims, 8 Drawing Figures

MULTIPURPOSE CLEANING DEVICE

FIELD OF INVENTION

This invention relates to cleaning means and more particularly to motor driven, multipurpose cleaning devices.

BACKGROUND OF INVENTION

Since man first began to maintain habitats, the problem of cleaning the same has been of concern. As times have changed, cleaning methods and equipment have necessarily had to adapt. As the use of rugs and carpeting has become more prevalent, vacuum cleaning devices have become more sophisticated. Likewise, as interior useable space such as office buildings, kitchens and the like have gone more and more to unitized type floor construction, floor scrubbers and buffers have developed accordingly.

In the area of bathrooms, however, very little specialized equipment has been developed to assist the housewife or other person cleaning the same even though this is a laborious and undesirable cleaning job. Generally speaking mechanized devices for bathroom cleaning are unavailable and the chore is usually accomplished with a short handled, U-shaped brush, a mop, a sponge and a lot of old-fashion "elbow grease".

After much research and study into the abovementioned problems, the present invention has been developed to provide a mechanized means for scrubbing and generally cleaning of habitat areas and particularly of bathroom type facilities.

In view of the above, it is an object of the present invention to provide an electrically powered cleaning device with attachments specifically designed for cleaning bathroom facilities.

Another object of the present invention is to provide a powered bathroom cleaning machine having means for dispersing a liquid cleanser onto the driven cleaning means.

Another object of the present invention is to provide a mechanized bathroom cleaning device having a plurality of varied shaped cleaning heads.

Another object of the present invention is to provide a bathroom type cleaning device including an elongated handle for stand-up cleaning such as floor tile and ceiling.

Another object of the present invention is to provide a cleaning implement having a removable, elongated, longitudinal handle and at least one relatively compact laterally disposed handle whereby a variety of cleaning jobs from various positions can be accomplished.

Another object of the present invention is to provide a specialized cleaning implement having a drive motor which is encapsulated within a relatively water impervious housing.

Another object of the present invention is to provide a detergent dispenser for use in conjunction with a motorized bathroom cleaning device which includes a plurality of dispersing openings.

Another object of the present invention is to provide a detergent dispenser for use in conjunction with a power driven cleaning machine wherein the detergent is dispersed in a circular pattern above the cleaning head.

Another object of the present invention is to provide a readily accessible handle for operation of a detergent dispersing means within a power driven bathroom cleaning system.

Other objects and advantages of the present invention will become apparent and obvious from a study of the following description and the accompanying drawings which are merely illustrative of such invention.

BRIEF DESCRIPTION OF DRAWINGS

FIG. 5 is a perspective view of the cap used when the longitudinal handle is removed;

DETAILED DESCRIPTION OF INVENTION

Figure 1:
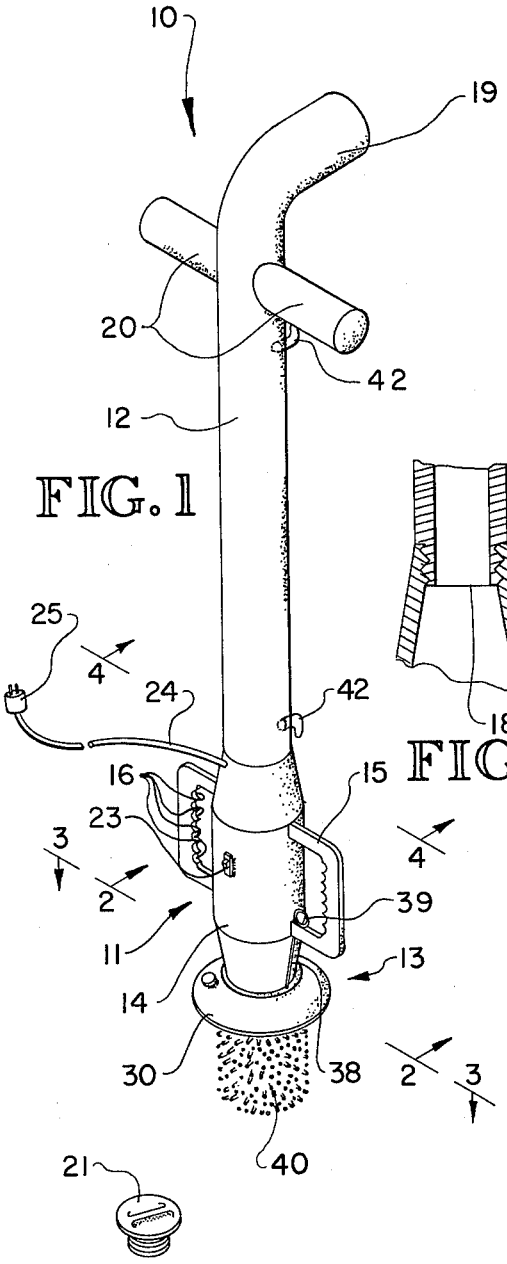
FIG. 1 is a perspective view of the cleaning implement of the present invention.
Figure 4:
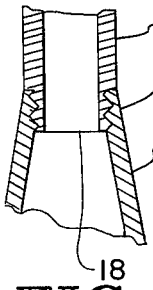
FIG. 4 is a sectional view taken through lines 4—4 of FIG. 1.

With further reference to the drawings, the cleaning device of the present invention indicated generally at 10 includes a motor portion indicated generally at 11, a longitudinally extension handle indicated at 12 and a cleaning head portion indicated generally at 13.

The engine or motor portion 11 includes a somewhat tapered, generally cylindrical shaped, preferably water impervious housing 14. Relatively small, hand-grip type handles 15 are secured on opposite sides of housing 14 as can clearly be seen in FIG. 1. Each of these handles are relatively small, compact and generally U-shaped in configuration. A plurality of finger engaging, nonslip, scalloped portions 16 are provided in the interior portion of each of the U-shaped handles.

One end of housing 14 terminates in an interior or female threaded portion 17. This portion is adapted to receive exteriorly or male threaded portion 18 of longitudinal handle 12. The direction of threading on male portion 18 into female portion 17 is, of course, in the direction opposite the torque of motor 22 thus assuring that motor portion 11 and handle portion 12 will remain tightly connected during operation of the cleaning device 10 of the present invention.

The opposite end of handle portion 12 opposite threaded end 18 terminates in an angularly disposed grip portion 19. Disposed adjacent grip portion 19 an outwardly extending on opposite sides of elongated handle 12 are a pair of control handles 20.

On the exterior of housing 14 is provided a control switch 23. This can either be a typical off-on switch or a multiposition speed control switch with positions such as "off", "low", "medium", and "high". Since control switches of this type are well known to those skilled in the art, further discussion of the same is not deemed necessary.

Figure 2:
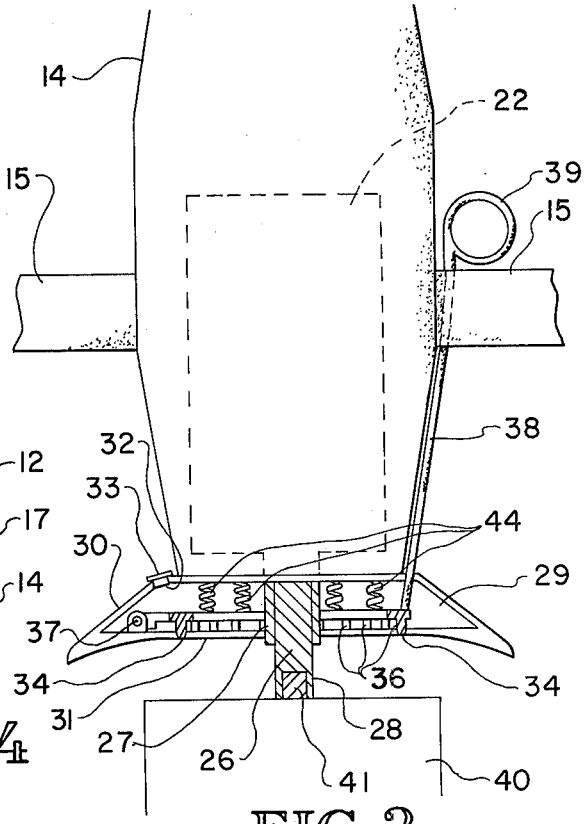
FIG. 2 is a sectional view taken through lines 2—2 of FIG. 1.

Operatively mounted within housing 14 is motor 22 as shown in dotted lines in FIG. 2. Since any number of different types of motors could be used for this purpose, further description of the same or the means of mounting are not deemed necessary since one skilled in the art can obviously accomplish the same in a number of different ways.

Power to operate motor 22 is provided through line cord 24 which has on the end thereof a standard plug 25.

The rotatable output shaft 26 of motor 22 passes through sleeve 27 and terminates at its outer end in a scrubber head connector sleeve 28.

A detergent reservoir housing 29 is provided which has an outwardly flared upper portion 30 and a somewhat concave lower portion 31. The upper portion 30 is secured to motor housing 14.

A filler opening 32 is provided in upper portion 30 as can clearly be seen in FIG. 2 and closure or plug 33 is adapted to snugly fit therein at all times except when the interior of the reservoir housing 29 is being filled.

A plurality of dispersing holes or openings 34 are provided through generally concave lower portion 31 of reservoir 29. As can clearly be seen in FIG. 3, these openings are disposed in a generally circular pattern centered about shaft 26.

A closure ring 35 is provided within reservoir 29 and includes on the lower side thereof (as disposed in the drawings) a plurality of preferably tapered closure pins 36. Each of these pins are adapted to align with one of the dispersing openings 34 thereby controlling the flow of detergent or other material from reservoir 29.

Figure 3:
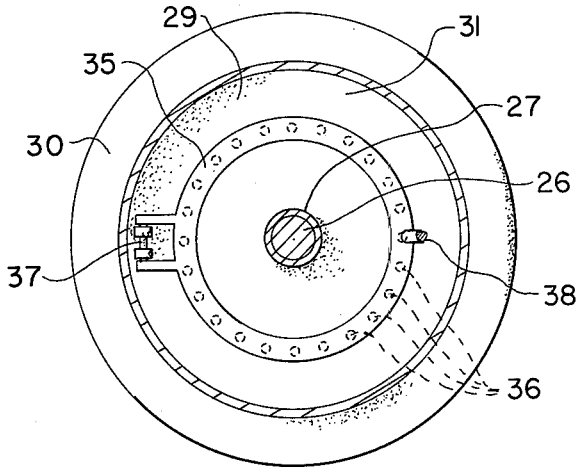
FIG. 3 is a sectional view taken through lines 3—3 of FIG. 1.

Closure 35 is pivotably mounted about hinge pin 37 as shown in FIGS. 2 and 3. On the opposite side of closure ring 35 from hinge 37 is secured one end of closure ring manipulating rod 38. The other end of this rod passes through the lower portion of one of the U-shaped handles 15 and terminates in a finger size pull ring 39.

As can clearly be seen in FIG. 2, when ring 39 is pulled inwardly (again as oriented in the drawings), rod 38 will move longitudinally raising closure ring 35 and pivoting the same about hinge 37. This maneuver will move the closure pins 36 out of plugging engagement with dispersing openings 34 and any liquid detergent or other material within the reservoir 29 will be allowed to run onto the scrubber head therebelow as will hereinafter be described.

Whenever the pulling pressure on rod 38 is released, the plurality of springs 44 compression biased between the interior of upper housing 30 and closure ring 35 will cause such closure means to automatically move into the closed position with closure pins 36 disposd within dispersing openings 34 as shown particularly clear in FIG. 2.

Figure 6:
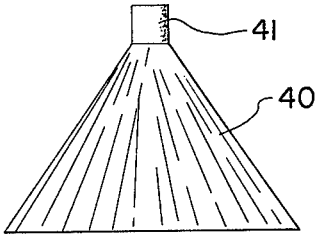
FIG. 6 is a side elevational view of a modified cleaning head.
Figure 7:
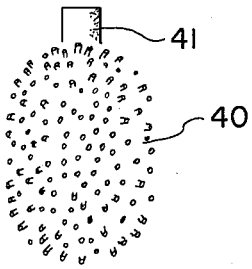
FIG. 7 is a side elevational view of an additional modified cleaner head.
Figure 8:
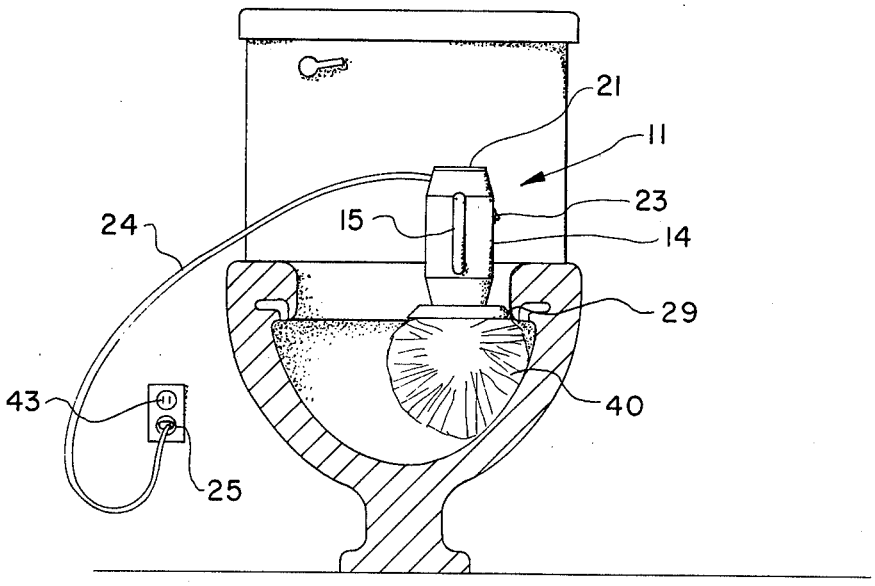
FIG. 8 is a sectional view of a typical household type water closet utilizing the device of the present invention with the elongated handle removed.

A plurality of different shaped scrubber heads 40 are illustrated and preferably provided. These can be bristle type brushes as shown in FIG. 6, oval or cylindrical shaped sponge as shown in FIGS. 7 and 1, or generally round shaped soft fiber constructed as illustrated in FIG. 8. Since different shaped scrubber heads are required or are better suited for different jobs, quick disconnect shaft 41 is provided which is adapted to operate in conjunction with connector sleeve 28.

A pair of oppositely disposed hook means 42 are provided on handle portion 12 and are adapted to receive, in winding fashion, line cord 24 for storage.

To use the device of the present invention, the scrubber head 40 best suited for the anticipated job is selected and its shaft 41 insertingly connected into connector sleeve 28 of shaft 26. If the cleaning job at hand would be more easily accomplished using the longitudinal handle portion 12 (such as scrubbing the floor's tile, the bottom of a bath tub or other remote areas, then such handle portion is screwed into the end of housing 14 to form the configuration shown in FIG. 1. Electrical plug 25 is then plugged into any convenient electrical outlet 43 and the unit is ready for operation. Switch 23 can then be turned on and if a multi-speed switch is used, the desired speed selected. By manipulation of control handles 20, an angle handle 19, the cleaning device of the present invention can easily be manipulated into remote areas without difficulty.

If wall tiles or other vertical surfaces are being cleaned, it may be desirable to manipulate the present invention by using one of the handles 15 at one end and either handle 19 or 20 at the other end of the device. Good control as well as leverage can be obtained under such circumstances.

Whenever relatively confined areas are encountered or the cleaning device with the elongated handle 12 is cumbersome, then such handle portion can be removed by simply unscrewing the same from housing 14 and the cleaning device manipulated through use of handles 15. This form of the present invention as shown in FIG. 8 is particularly suitable for use in connection with water closet bowls, lavatories, restricted shower stalls and the like. As the cleaning proceeds from one location to another, the scrubber heads 40 can be interchanged as deemed appropriate for the facility involved.

A plug 21 is provided in housing 14 when handle 12 is removed to prevent dirt or other foreign matter from entering the threaded handle opening.

Depending on the type of cleaning being accomplished, should it be desired to apply a detergent or other substance to the scrubber head 40, the reservoir 29 can be filled through opening 32 and closure 33 used to prevent accidental spilling of the contents. Whenever dispersing is desired, ring 39 is simply pulled to remove the closure pins 36 from dispersing openings 34 thereby allowing the contents of the reservoir to be dispersed onto the adjacent scrubber head.

From the above, it can be seen that the present invention has the advantage of providing a relatively simple and yet highly efficient cleaning device which can be used either as a completely hand-held unit or can be manipulated remotely through use of an elongated handle portion. The present invention has the additional advantage of being adaptable to many specific jobs by simply changing the scrubber head to a different configuration. Not only is the present invention a cleaning device but it also provides a means to disperse detergent and other materials adjacent the operating portion of the unit.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended Claims are intended to be embraced therein.

What is claimed is:

1. An improved cleaning means comprising: a motor portion; an elongated handle portion removably secured to said motor portion; at least one outwardly disposed side handle means secured to said motor portion; a scrubber head operatively attached to said motor portion opposite said elongated handle connection and adapted to be driven by a motor within said housing; a material dispersing means operatively disposed between said motor portion and said scrubber head, said dispersing means being in the form of a generally circular housing having a plurality of normally closed dispersing openings disposed in a generally circular pattern provided therein whereby an improved cleaning means which can be operated both remotely from the scrubber head and in restricted areas is provided.

2. The cleaning means of claim 1 wherein a pair of side handle means are provided for said motor portion.

3. The cleaning means of claim 1 wherein a plurality of interchangeable scrubber heads are provided.

4. The cleaning means of claim 1 wherein the motor within the motor portion for operating the scrubber head is of the variable speed type.

5. The cleaning means of claim 1 wherein a means for opening said normally closed dispersing openings is provided.

6. The cleaning means of claim 5 wherein the opening means is remotely operated.

7. The cleaning means of claim 6 wherein said remotely operated opening means is in the form of a pull rod connected at one end to said dispersing means and at the other end to a hand means.

* * * * *